United States Patent [19]

Webster et al.

[11] 4,244,061

[45] Jan. 13, 1981

[54] URINALS

[75] Inventors: Cyril J. D. Webster; John C. Griggs, both of St. Albans, England

[73] Assignee: National Research Development Corporation, London, England

[21] Appl. No.: 942,196

[22] Filed: Sep. 14, 1978

[30] Foreign Application Priority Data

May 12, 1978 [GB] United Kingdom ..... 19224/78

[51] Int. Cl.[3] ..... A47K 11/00

[52] U.S. Cl. ..... 4/144.1; 137/247

[58] Field of Search ..... 4/197, 206, 207, 301, 4/310, 311, 144.1, 191, 222, 232, DIG. 11, DIG. 13, DIG. 16, 309, 424, 440; 128/295; 137/247

[56] References Cited

U.S. PATENT DOCUMENTS 292,055 1/1884 Riker ..... 4/207

FOREIGN PATENT DOCUMENTS 414917 8/1934 United Kingdom .
1143624 2/1969 United Kingdom .
1288781 9/1972 United Kingdom .
1547529 6/1979 United Kingdom .

OTHER PUBLICATIONS

Water Installation and Drainage Systems, The Construction Press, Published in Lancaster, London and New York, 1978.

*Primary Examiner*—Houston S. Bell, Jr.
*Attorney, Agent, or Firm*—Cushman, Darby & Cushman

[57] ABSTRACT

A urinal arrangement for flushless hygienic operation has a sealing trap with a bend portion having a bore of not more than 25 mm. The bore size produces "plug flow" through the trap so that liquid retained in the trap as a seal is displaced in use by new liquid without significant mixing of new and displaced liquid. The small bore reduces the exposed surface area of the retained liquid forming the seal.

21 Claims, 1 Drawing Figure

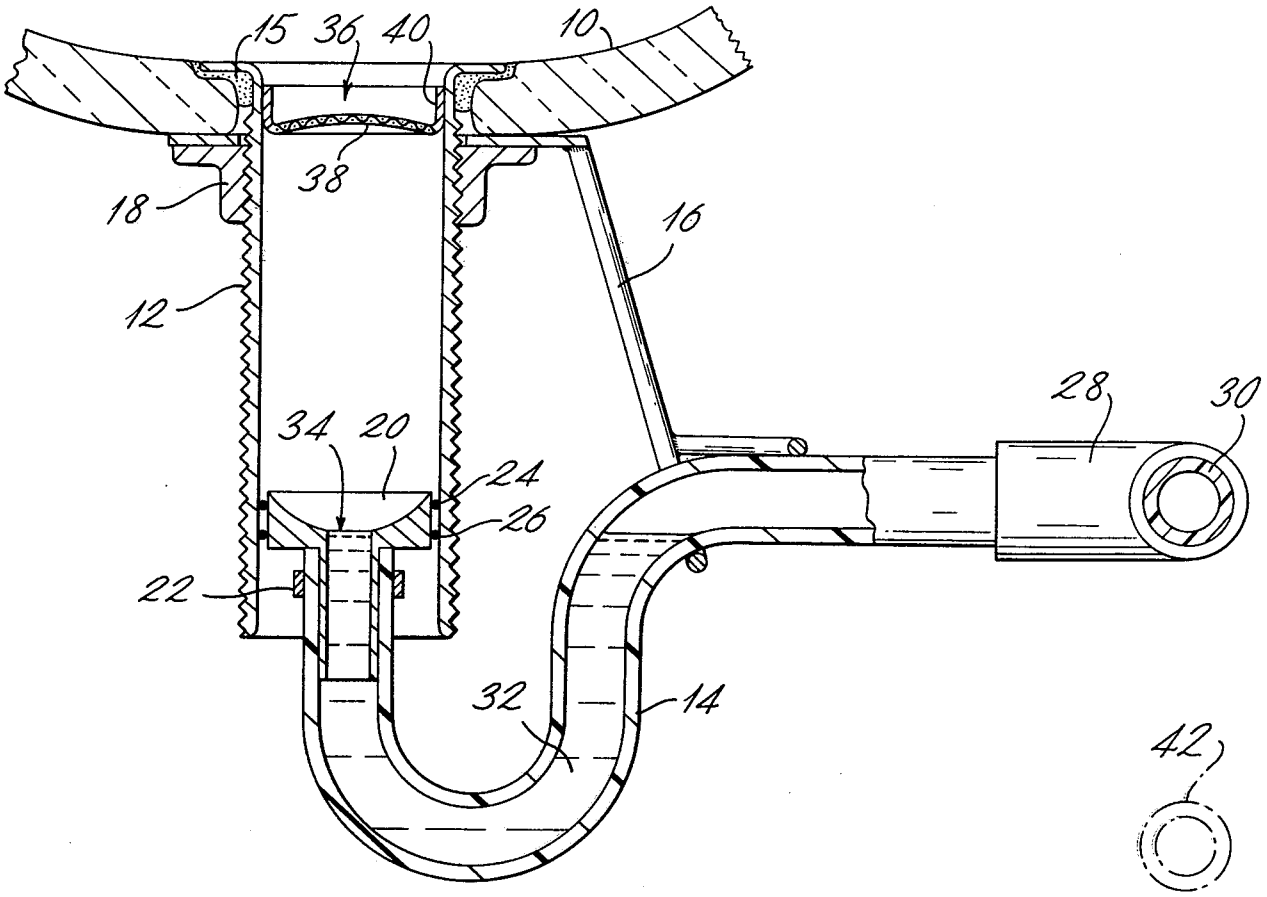
30
28
42
16
10
14
32
24
26
40
20
36
38
34
15
18
12
22

URINALS

This invention relates to urinals.

Urinals are conventionally provided with a source of flushing water operated from time-to-time to flush out the urinal trap into a connected water-borne sewage system. Such a flushing arrangement is often a requirement of building or public health regulations. Moreover the need to provide a supply of water and the mechanism to flush the urinal increases the cost and size of the installation particularly in places where transport of raw materials is expensive and a regular supply of water expensive or unobtainable.

Attempts have therefore been made to produce a urinal which does not require a source of flushing water for effective operation. One arrangement which has been accepted by some authorities is the System Ernst. This is an old-established arrangement described in United Kingdom Agrement Board Certificate 69/34 published 1969. This arrangement is a special urinal stall which uses a multipart cylindrical cast-iron trap defining three concentric volumes fitted to an in situ cement bowl. The trap is initially provided with a quantity of a proprietary mineral oil which forms a seal of a layer some 13 mm thick floating on urine retained in the trap. The total trap depth is some 70 mm. The volume of oil required initially for the 13 mm seal is about 0.04 liter as a ring in the outermost concentric volume. The total trapped liquid volume is some 0.3 liter. Although the arrangement does not require a source of flushing water it does require regular attention, say every six months, to replace the oil seal which is reduced a little at each use. Also the oil can be displaced entirely if, for example, a bucket of liquid is emptied through the trap, the sudden surge washing away the oil. Furthermore the form of the trap prevents it being installed in a conventional urinal bowl or stall.

There is therefore a need for a urinal arrangement including a trap which does not require flushing to remain hygienic, does not require regular attention and can withstand a sudden surge of liquid.

It is an object of the invention to provide a urinal which can be hygienically operated without a source of flushing water.

According to the present invention, a urinal is provided with a trap of dimensions such as to encourage plug flow of liquid through the trap.

By "plug flow" in this context and throughout the specification is meant a flow in which new liquid entering the trap will displace liquid already present there without significant mixing occurring in the trap.

Traps having the above characteristics will hereinafter be referred to as "plug-flow" traps.

Tests indicate that plug flow will occur if the internal diameter of the trap cross-section lies in the range 8 mm to 25 mm values of around 10–15 mm and more specifically about 12 mm being currently preferred.

Preferably also the maximum amount of liquid that can be held in the trap should not exceed 0.1 liters.

An advantage of using plug flow traps is that water flushing of the urinal is no longer necessary because the urine in the trap during normal use will be fresh and therefore without unpleasant odour. Thus in a preferred form, the invention comprises a urinal provided with a trap of dimensions such as to encourage plug flow of liquid through the trap and without any source of flushing water present in or associated with the urinal.

According to a particular aspect of the invention there is provided a urinal trap including an entry portion, a bend portion to contain liquid as a sealing trap and an exit, tail, portion, the entry portion forming at least part of a urinal waste connection and the bend portion having a bore of not more than 25 mm to restrict the trapped liquid volume to not more than 0.1 liters while maintaining, in use, a trap seal on the flow of new liquid into the entry portion to displace retained liquid from the trap seal for exit through the tail portion without significant mixing of new and displaced retained liquid occurring.

A urinal trap as described above may be fitted to a urinal bowl for use without the provision of a supply of flushing water. The trap may be fitted to a conventional waste by the sealing engagement of a director of the trap to the waste and the placing of a removable filter in the trap entry. The filter may be a wall portion supporting at the bottom of the wall a lower layer of an array of horizontal perforated plastics material and an upper layer of perforated plastics material curved upwardly to a dome shape, the wall portion fitting into the waste entry.

An embodiment of the invention will now be described, by way of example only, with reference to the accompanying drawing in which a urinal bowl 10 is provided with a conventional plastic waste 12 (e.g. of polyethylene) fitted with a plug-flow trap 14 formed from 12 mm inside diameter reinforced plastics pipe (e.g. of p.v.c.). A mass of plasticine (R.T.M.) 15 is used to provide a seal between the bowl 10 and the waste 12. In accordance with the preferred form of the invention, the bowl 10 is "waterless" i.e. no source of flushing water is intended or provided.

A support 16 is secured to bowl 10 by a back-nut 18. The support 16 supports the top bend of trap 14 which at its free end is secured to a director 20 by a clip 22. A watertight seal is provided by two O-rings 24, 26. At its other end the trap is connected by a T-junction 28 to a conventional waste pipe 30 (not to scale). In practice the height of the director 20 is adjusted so that the level of urine 32 trapped in the trap is not above the opening 34 in the director. In this way the surface area of exposed urine is kept small without restricting the free flow of liquid through the trap. The depth of the liquid in the trap should be sufficient to prevent seal loss due to pressure variations in the waste pipe 30. Typically, in the United Kingdom for example, a trap depth of some 50 mm should be sufficient for this purpose.

The arrangement may be completed by a removable filter 36 having an upwardly domed mesh base 38 and an upstanding wall portion 40. The upstanding wall portion helps to trap debris for subsequent removal. In an alternative embodiment (not illustrated), the illustrated filter 36 is replaced by a double grid version comprising an array of horizontal perforated plastic strips in roughly the same plane as the bottom edge of a wall portion corresponding to wall portion 40 and a second array of perforated plastic strips at right angles to those of the first array and curved to give a similar domed profile to that of the illustrated base 38. The perforations are sized to permit easy entry of liquid without obstructing the escape of displaced air. Typically perforations of about 2 to 3 mm are suitable.

In an alternative installation of the illustrated urinal the P-trap form is modified to the S-trap form by arranging for the horizontal tail to extend for a length of at least 75 mm before dipping down, e.g. through a right angle, to a waste pipe at a level lower than pipe 30 and, if required, below the level of the trap. Such a lower level is indicated at 42 by the broken-line cross-sectional view of the waste pipe. The minimum horizontal length of 75 mm ensures that self-syphonage of the trap does not occur.

The trap is shown with an adjustable director 20 for the reason mentioned above. The adjustable director also facilitates the installation of a "run" of urinal bowls as the fall of the waste pipe 30 (or 42) is easily accommodated by adjusting the position of director 20. This adjustment also facilitates the fitting of the trap to existing bowls in place of conventional traps. Clearly the director need not be adjustable and the use of a conventional waste is not essential, the director could be formed to fit to the conventional bowl outlet aperture. Provision for a filter such as 36 is generally desirable in all cases however.

A plastics material is preferred for the parts exposed to or submerged in urine as it has been found that the metals commonly used in plumbing, i.e. zinc, brass, lead, copper, chromium plate etc., all corrode rapidly in such use. However, metals with suitable plastics or other coatings may be usable and the invention is not restricted to embodiments wholly of plastics material. Glass is another possible material.

We claim:

1. A urinal provided with a trap including pipe means at the inlet of said trap having a reduced cross-sectional area for limiting the surface of urine exposed to the atmosphere following use, said pipe means having an inlet and exit end for retaining a predetermined volume of liquid following each use, the reduced cross-section portion of said pipe means being dimensioned so that new liquid enters and passes through said pipe means substantially as a plug displacing at least a portion of the liquid retained in said pipe means without significant mixing between the new and retained volumes.

2. A urinal as claimed in Claim 1 in which the internal diameter of said pipe means ranges from 8 mm to 25 mm.

3. A urinal as claimed in claim 1 in which the internal diameter of said pipe means ranges from 10 mm to 15 mm.

4. A urinal as claimed in claim 1 in which the internal diameter of said pipe means is about 12 mm.

5. A urinal as claimed in claim 1 in which the maximum amount of liquid that can be held in the trap does not exceed 0.1 liters.

6. A urinal as claimed in claim 1 without any source of flushing water present in or associated with the urinal.

7. A urinal as claimed in claim 1 including a filter at the outlet to the urinal bowl, said filter having an upwardly domed mesh base surrounded by an upstanding wall portion.

8. A urinal as claimed in claim 1 including a filter at the outlet to the urinal bowl, said filter comprising a wall portion, an array of substantially horizontal perforated plastic strips in roughly the same plane as the bottom edge of the wall portion, and a second array of perforated plastic strips at right angles to those of the first array and curved to give an upwardly domed profile.

9. A urinal as claimed in claim 7 in which the filter is removable.

10. A urinal trap for use in discharging fluids and receiving new volumes of fluid to reduce unpleasant odor including an entry portion, a bend portion to contain liquid as a sealing trap and an exit, tail, portion, the entry portion having a reduced cross-sectional portion forming at least part of a urinal waste connection and the bend portion having a bore of not more than 25 mm to restrict the trapped liquid volume to not more than 0.1 liters while maintaining a trap seal on the flow of new liquid into the entry portion to displace retained liquid from the trap seal for exit through the tail portion without significant mixing of new and retained liquid volumes.

11. A urinal bowl installation fitted with a trap according to claim 10 and arranged for hygienic use without the provision of a supply of flushing water.

12. A urinal bowl installation according to claim 11 including a director sealingly engaged with the bowl waste and a removable filter in the trap entry.

13. A urinal bowl installation according to claim 11 including a removable filter of an upstanding wall portion defining an aperture, a substantially horizontal perforated plastics layer across said aperture at the bottom of the wall and a further perforated plastics layer above the horizontal layer and domed upwardly into the middle of the aperture.

14. A urinal as in claim 2 wherein said pipe means includes inlet means attached to the inlet end for providing an inlet to said pipe means, said inlet means having a diameter smaller than the diameter of said pipe means.

15. A urinal as in claim 4 wherein said pipe means includes inlet means attached to the inlet end for providing an inlet to said pipe means, said inlet means having a diameter smaller than the diameter of said pipe means.

16. A urinal as in claim 14 wherein said inlet means is slidingly secured to said pipe means.

17. A urinal as in claim 14 wherein said inlet means is comprised of an upper portion having an outer diameter larger than said pipe means and adapted to be sealingly connected to said urinal and a lower portion having an outer diameter equal to the inner diameter of said pipe means.

18. A urinal as in claim 17 wherein said inlet means is adjustably secured within said pipe means.

19. An improved trap for use with flowing liquids comprised of inlet means for establishing flow into said trap, downstream pipe means having an inlet end connected to said inlet means and an exit end, said pipe means creating together with said inlet means a plug type flow of liquid therethrough, said pipe means having an internal diameter ranging from about 8 mm to about 25 mm so that liquid entering said trap will displace liquid retained therein without any substantial mixing occurring between the new and retained liquids, wherein said inlet means includes a restricted portion having a reduced cross-sectional area smaller than the cross-sectional area of said pipe means, said restricted portion retaining a predetermined volume of liquid held by the trap so that the surface area of liquid exposed at the inlet side of said trap is reduced with respect to said pipe means.

20. In an urinal having a bowl with an outlet opening into a discharge pipe and a trap formed in the discharge pipe downstream from said outlet wherein the improvement comprises restriction means positioned at the inlet of said trap at the point where the trap establishes the surface of the waste liquid exposed to the atmosphere below said outlet for reducing the cross-sectional area of the discharge pipe and for retaining a predetermined volume of the waste liquid so that the waste liquid exposed to the atmosphere is reduced and subsequent flow from the outlet can displace the retained predetermined volume.

21. A urinal having a bowl provided with an outlet opening into a discharge pipe, a trap containing a volume of waste liquid formed in the discharge pipe downstream from the bowl outlet, said trap having a reduced cross-sectional portion positioned at the inlet of said trap and at a point substantially equal in height to the height of the liquid at the outflow end of the trap, said reduced cross-sectional area containing a reduced volume of the waste liquid within the trap to thereby reduce the surface area of the waste liquid exposed therein to the atmosphere below said bowl outlet.

* * * * *